US008439636B1

(12) United States Patent
Liang

(10) Patent No.: US 8,439,636 B1
(45) Date of Patent: May 14, 2013

(54) TURBINE BLADE OUTER AIR SEAL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 609 days.

(21) Appl. No.: 12/582,313

(22) Filed: Oct. 20, 2009

(51) Int. Cl.
*F01D 11/08* (2006.01)

(52) U.S. Cl.
USPC ..... 415/213.1; 415/173.1; 415/214.1

(58) Field of Classification Search ..... 415/115, 415/173.1, 173.2, 213.1, 214.1
See application file for complete search history.

(56) References Cited

U.S. PATENT DOCUMENTS

| | | | | | |
|---|---|---|---|---|---|
| 3,836,279 | A * | 9/1974 | Lee | 415/116 |
| 4,011,718 | A * | 3/1977 | Asplund | 60/796 |
| 4,247,248 | A * | 1/1981 | Chaplin et al. | 415/136 |
| 4,337,016 | A * | 6/1982 | Chaplin | 415/116 |
| 4,553,901 | A * | 11/1985 | Laurello | 415/138 |
| 4,650,394 | A * | 3/1987 | Weidner | 415/115 |
| 4,650,395 | A * | 3/1987 | Weidner | 415/116 |
| 4,688,988 | A * | 8/1987 | Olsen | 415/116 |
| 4,720,236 | A * | 1/1988 | Stevens | 415/136 |
| 5,333,992 | A * | 8/1994 | Kane et al. | 415/138 |
| 6,062,813 | A * | 5/2000 | Halliwell et al. | 415/174.5 |
| 2008/0118346 | A1* | 5/2008 | Liang | 415/115 |
| 2008/0127491 | A1* | 6/2008 | Lee et al. | 29/888.02 |
| 2011/0027068 | A1* | 2/2011 | Floyd et al. | 415/13 |

* cited by examiner

*Primary Examiner* — Edward Look
*Assistant Examiner* — Liam McDowell
(74) *Attorney, Agent, or Firm* — John Ryznic

(57) ABSTRACT

A BOAS assembly for a gas turbine engine with a full annular impingement ring secured in place above BOAS segments between front and aft full retainer rings and the front and aft hooks on the BOAS segments. The full impingement ring uncouples the impingement ring from the BOAS segments and eliminates gaps for cooling air leakage so that all of the cooling air is used for impingement cooling of the BOAS segments. A long tongue extending from the aft retainer rings guides the impingement ring and the BOAS segments into place during assembly.

4 Claims, 1 Drawing Sheet

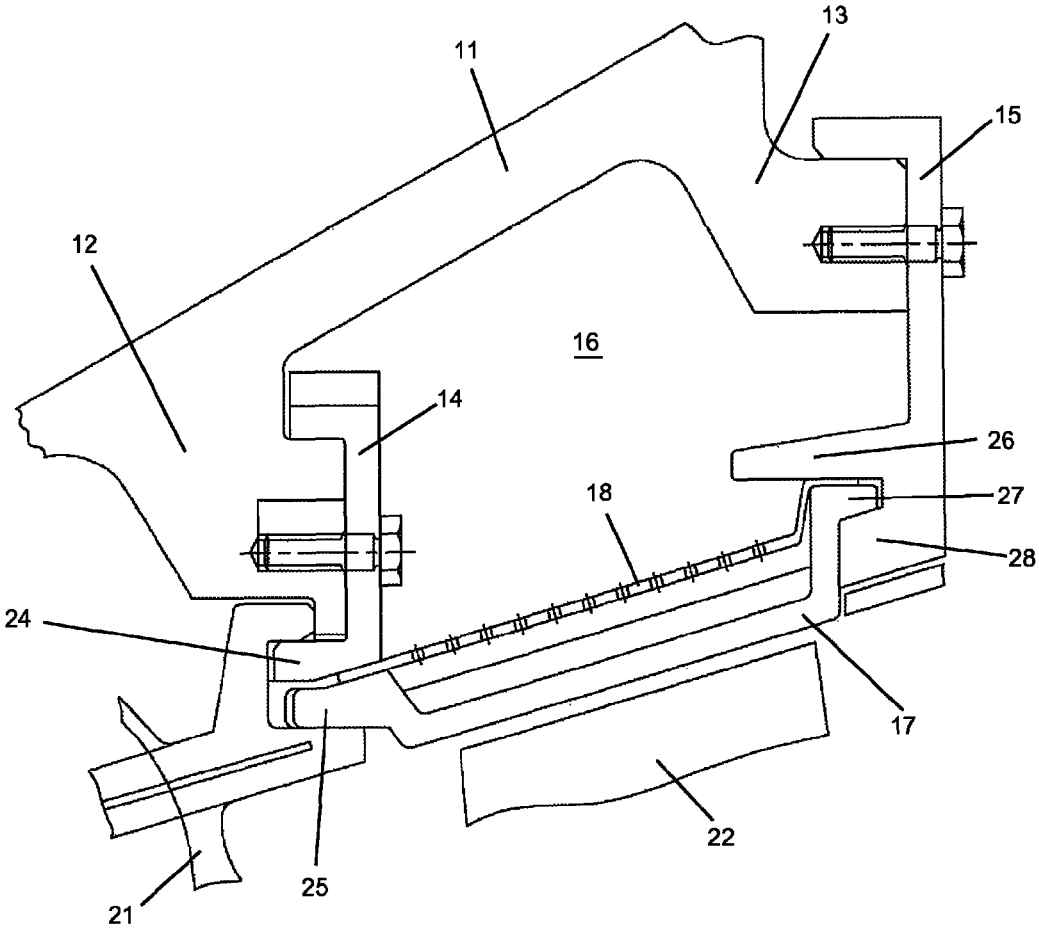
11
13
15
12
16
14
26
27
18
28
24
17
22
25
21

TURBINE BLADE OUTER AIR SEAL

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a segmented blade outer air seal or BOAS.

2. Description of the Related Art Including Information Disclosed Under 37 CFR 1.97 and 1.98

A gas turbine engine includes a turbine with multiple rows or stages of stator vanes and rotor blades. A blade outer air seal (BOAS) forms a gap with tips of the rotor blades. The BOAS is a full 360 degree annular section that is formed from segments. Each BOAS segment includes an inner surface that forms the gap with the blade tips and an outer surface that is covered by an impingement plate with impingement holes formed therein to provide impingement cooling on the outer or backside surface of the BOAS segments. Each BOAS segment has a separate impingement plate typically brazed to the segment. Each BOAS segment also includes forward and aft hooks that are used to secure the segment in place on the turbine casing. Because of thermal growth from engine operation, the BOAS segments are formed with mateface gaps (the gap between adjacent segments) and sealed with a flat seal to prevent hot gas flow up from the inner gas flow path and cooling air flowing into the inner hot gas flow path.

One problem with the prior art segment design is when the impingement plate becomes detached from the segment or has a hole burned through, the cooling air from the cooling air supply cavity above the impingement plate will leak into the mateface gaps and forward and aft hook gaps. Since the impingement plates are also a separate plate, when one becomes loose nothing will hold the plate in place. Also, because of separate impingement plates, brazing or other bonding is required for assembly that also reduces the impingement plate durability because the impingement plate is coupled to the BOAS segment.

Forward and aft retainer rings are also used to provide support surfaces for the BOAS segments. Any gaps formed between the retainer rings and the segments will require a seal to prevent hot gas flow or cooling air leakage.

BRIEF SUMMARY OF THE INVENTION

It is an object of the present invention to provide for a segmented blade outer air seal assembly without individual impingement plates secured to individual segments in order to decouple the impingement plate from the segment.

It is another object of the present invention to provide for a segmented blade outer air seal assembly with improved cooling air flow metering capability for the BOAS.

It is another object of the present invention to provide for a segmented blade outer air seal assembly to utilize the cooling air leakage flow for cooling first then purge all leakage gap is a more effective way of use leakage flow.

It is another object of the present invention to provide for a segmented blade outer air seal assembly which will eliminate brazing of the impingement plate to the backside surface of the BOAS segment.

It is another object of the present invention to provide for a segmented blade outer air seal assembly in which the BOAS will still function in the event of a loss of mate-face seal or burn through a hole in the impingement plate.

The above objective and more are achieved with the BOAS of the present invention in which a full annular one piece impingement ring is secured in place between chamfer edges formed on front and aft retainer rings and front and aft hooks on the segments. Front and aft retainer rings are bolted to the turbine casing to secure the impingement plate and BOAS segments in place. The segments are conical in shape for ease of installation in which the impingement plate and the segments are inserted into a slot in the upstream vane assembly and the front retainer ring secured in place. Then, the aft retainer ring is bolted to the turbine casing to secure the aft end of the impingement plate and segments in place. No brazing or bonding of the impingement plate is required because of the retainer rings and the impingement plate can be one full annular piece to eliminate problems due to hole burn through or breakage of the bond.

BRIEF DESCRIPTION OF THE SEVERAL VIEWS OF THE DRAWINGS

FIG. 1 shows a cross section side view of the blade outer air seal of the present invention.

DETAILED DESCRIPTION OF THE INVENTION

The blade outer air seal (BOAS) of the present invention is intended for use in an industrial gas turbine (IGT) engine, but can also be used in an aero engine. In the turbine of an engine, a BOAS is used to form a seal with the stage of rotor blades. Each stage of rotor blades in the turbine is associated with a separate BOAS. The BOAS is formed of a plurality of segments 17 that together form a full annular segment.

FIG. 1 shows one stage of the BOAS of the present invention and includes a turbine casing 11 with a forward or front hook 12 and a rearward or aft hook 13 in which the BOAS assembly is secured. A front retainer ring 14 secures the front end of the BOAS to the turbine casing 11 and an aft retainer ring 15 secures the aft end of the BOAS to the turbine casing 11. A plurality of bolts is used to secure both retainer rings 14 and 15 to the respective hooks 12 and 13. The front and aft retainer rings 14 and 15 are both full annular rings of 360 degrees.

The BOAS segments 17 are conical in shape with the front end having less of a diameter than the aft end. Each BOAS segment 17 is identical in shape. The BOAS segment 17 includes a front hook 25 with an upper surface that is slanted from 3 to 10 degrees from the axis of the turbine. The aft end of the segment includes an aft hook 27 that fits within a groove formed between inward facing projections 26 and 28 on the inner side of the aft retainer ring 15. The front retainer ring 14 includes a lower flange surface with an inner surface having a slanted surface of similar slope to that of the outer surface on the front hook 25 of the segment 17. The inward facing projections 26 and 28 on the aft retainer ring 15 form a chamfered groove in which a hook of the segment 17 can be fitted. The projection 26 forms a chamfered long tongue. The front and aft retainer rings 14 and 15 are both full annular rings of 360 degrees to reduce gaps in which cooling air leakage will occur.

A full annular impingement ring 18 is used in the present invention instead of separate impingement plates for each segment 17. The impingement ring 18 is also conical in shape with a lower front end than the aft end and is basically flat from the front end to near the aft end where the ring 18 turns upward and then rearward with a slant downward as seen in FIG. 1. This shape of the impingement ring 18 allows for the front and aft ends to be pinched between the retainer rings 14 and 15 and the vane hooks on the front end. The impingement ring 18 includes a front end that is secured to the front retainer ring 14, an aft end that includes a first bend piece and a second bend piece that is secured to the aft retainer ring 15, and a middle section that extends between the front end and the aft end and includes the impingement holes that pass impingement cooling air onto the BOAS segments. The aft retainer ring 15 includes a chamfered long tongue 26 that extends inward to from a slot with a lower inward facing flange 28. The slot has a decreasing height toward the bottom surface of the slot for reasons described below in pinching the impingement ring 18 in place. The impingement ring 18 includes impingement holes to produce impingement cooling of the backside surface of the segments 17 with cooling air from a cooling air supply cavity 16.

The front retainer ring 14 includes a lower flange 24 with a chamfered edge having a similar slope as the impingement ring 18 and the front hook 25 of the segment 17. Thus, the abutment surfaces between the retainer rings 14 and 15 and the front and aft hooks 25 and 27 of the segments 17 have the same slope so that the impingement ring 18 can be tightly pinched between the abutment surfaces when the retainer rings 14 and 15 are secured by the bolts in place on the turbine casing hooks 12 and 13.

The front hook 25 of the segments 17 is pinched between the inner surface of a slot formed on the vane endwall and the underside surface of the impingement ring 18 and chamfered edge 24 of the lower flange of the front retainer ring 14. This side of the impingement ring 17 and segments is inserted into the casing first and the front retainer ring bolted to the casing hook 12. Then, aft end of the impingement ring 18 and the aft hooks 27 of the segments is fitted into the slot formed on the aft retainer ring 15 and secured together with the bolts. With this design, the annular impingement ring 18 does not need to be bonded to the segments. Also, the annular impingement ring 18 is without gaps that will allow for cooling air leakage. The annular impingement ring 18 creates a seal between the retainer rings and the segments to limit cooling air leakage.

During assembly of the engine, the full annular impingement ring 18 and the BOAS segments 17 are pre-assembly together, holding both pieces temporary at the aft hook location by insertion, inserting into the spacing in-between the front retainer ring 14 and vane 21 aft hooks. The front retainer ring 14 is bolted to the casing with the adjacent vane secured in place and the vane outer diameter endwall support secured between the casing hook and the lower end flange of the front retainer ring as seen in FIG. 1. The assembling is performed vertically for an aero engine application and horizontally in an IGT engine. Once the full annular impingement ring 18 and BOAS segments 17 are installed into the front retainer ring 14 spacing, the aft retainer ring (a full annular ring) 15 is inserted onto the full impingement ring 18 and the aft hooks of the BOAS segments 17. The long tongue 26 on the aft retainer ring 15 will function to guide the full impingement ring 18 and the BOAS segments 17 into proper position for final assembly. The long tongue 26 sticks out further than the lower flange 28 for this purpose. The bolts on the aft retainer ring 15 is then tightened to position the assembly into the final state with the full impingement ring 18 secured in place between the retainer rings 14 and 15 and the BOAS segments 17. The bend for the aft portion of the impingement ring 18 will lock-up into the chamfered slot formed within the inner side of the BOAS aft hook 27. With the chamfered long tongue 26 on the aft retainer ring 15, as the aft retainer ring slides 15 into the assembly, the aft retainer ring 15 will provide the guiding surface for the impingement ring 18 and BOAS segments 17 and thus catch both components while locking the aft portion of impingement ring 18 and BOAS segments 17 into the convergent groove or slot formed between 26 and 28.

Key design elements for this full ring cooling and assembly BOAS are listed follow: The multi-impingement full ring cooling device is formed with a forward conical cone section with a bend inward aft cone section (3 to 10 degrees). The forward conical cone section is in parallel to the BOAS hot flow path. Forward retainer ring for the vane assembly with a chamfered bottom surface is used. The angle for the chamfered surface is inline with the BOAS hot flow path angle. BOAS forward hook with top surface conical angle inline with the hot flow path as well as same as the front retainer ring bottom surface. The bottom surface of the front hook surface will mate with the vane outer diameter endwall hook support. BOAS is formed with multiple pieces pending on the design requirement. BOAS aft hook is formed with top surface bend inward at the same angle as the full impingement ring aft cone section. The lower surface will mate with the after retainer ring for the BOAS assembly. The after retainer ring for the BOAS assembly includes a convergent groove for the retaining of impingement ring and BOAS aft hook. A long tongue with chamfer surface is used to secure the impingement ring and BOAS assembly.

Advantages of this full ring and BOAS assembling design concept are listed below. All leakage and cooling flow are cached by the full impingement ring device and used for the BOAS backside impingement cooling. The multi-impingement cooling concept provides an excellent cooling flow metering capability for the BOAS. Utilize the leakage flow for cooling first then purge all leakage flow through gaps between the abutment surfaces is a more effective way of use leakage flow. Eliminated all peripheral EDM cooling holes. Positive seal edge cooling is achieved. Seal growth potential is improved for a higher temperature application. Enhance BOAS life by de-coupling the impingement plate from the BOAS substrate to improve durability of the component. Eliminate brazing process for backing plate associate with backside impingement plate design. The unique assembly process and design features for the front and aft hooks arrangement thus eliminate the use additional seals in-between the hook attachment and the retainer rings. The overall BOAS design has been simplified. In case of BOAS malfunction, for example loss of mate-face seal or burn through a hole, the full impingement ring will still be able to contain the entire cooling air as well as provide backside impingement cooling to all BOAS. It is a good fail-safe design concept.

I claim the following:

1. A BOAS for a turbine in a gas turbine engine, the BOAS comprising:

a turbine casing with a forward hook and an aft hook;

a front retaining ring secured to an aft side of the forward hook;

an aft retaining ring secured to an aft side of the aft hook;

the front retaining ring having a lower flange with a surface to abut a forward end of an impingement plate;

the aft retaining ring having a forward extending projection and a forward extending longer projection that together form a progressively decreasing height slot;

a blade outer air seal having a conical shape;

the impingement plate is a conical shaped full annular impingement plate with a forward end and an aft end;

the forward end of the conical shaped impingement plate secured between the lower flange of the front retaining ring and a forward end of the blade outer air seal in a free floating assembly; and, the aft end of the conical shaped impingement plate secured between the forward extending longer projection and an aft end of the blade outer air seal in a fixed assembly.

2. The BOAS of claim 1, and further comprising:

the front retaining ring and the aft retaining ring are both full annular retaining rings.

3. The BOAS of claim 1, and further comprising:

the aft end of the impingement plate has an S shape.

4. The BOAS of claim 1, and further comprising:

the forward end of the impingement plate is straight and parallel to a middle section of the impingement plate.

* * * * *